United States Patent [19]

Nissinen

[11] 4,167,599

[45] Sep. 11, 1979

[54] MAT AND UNITS THEREOF

[76] Inventor: Esko Nissinen, Kaskenkatu 11 D 91, 20700 Turku 70, Finland

[21] Appl. No.: 825,187

[22] Filed: Aug. 16, 1977

[51] Int. Cl.[2] ..... B32B 3/10; B32B 3/06

[52] U.S. Cl. ..... 428/44; 428/131; 428/136; 428/192; 52/177; 52/593; 404/36; 404/41; 4/185 F

[58] Field of Search ..... 4/185 R, 185 F, 185 AB; 52/653, 656, 687, 177, 180, 593; 428/33, 44, 46, 52–55, 81, 134, 167, 188, 192; 404/35, 36, 41

[56] References Cited

U.S. PATENT DOCUMENTS

| | | | |
|---|---|---|---|
| 3,274,727 | 9/1966 | Zander | 46/16 |
| 3,438,312 | 4/1969 | Becker et al. | 428/137 X |
| 3,802,144 | 4/1974 | Spica | 404/41 X |
| 3,846,945 | 11/1974 | Roby | 52/177 |
| 3,909,996 | 10/1975 | Ettlinger, Jr. | 52/177 |

*Primary Examiner*—George F. Lesmes
*Assistant Examiner*—Alexander S. Thomas
*Attorney, Agent, or Firm*—Steinberg and Blake

[57] ABSTRACT

A mat, such as a bath mat, is made up of a plurality of units which are releasably joined to each other to form a continuous mat structure. Each of these units has a continuous peripheral flange provided with upper and lower edges and an open network of intersecting ribs surrounded by and integral with this flange while being situated at least in part between the upper and lower edges thereof, and in particular spaced upwardly from the lower edge of the peripheral flange. Each unit has a plurality of short feet integral with and distributed along while extending downwardly from the lower edge of the peripheral flange and a plurality of long feet integral with the open network of intersecting ribs and extending downwardly therefrom, all of these feet terminating in lower ends which are situated in a common plane parallel to the lower edge of the peripheral flange. This flange has at least one pair of elongated opposed connecting regions one of which carries a plurality of integral fastener projections each formed with a downwardly directed recess having a bottom open end and the other flange region is formed with a plurality of notches for respectively receiving the fastener projections of an adjoining unit with the flange portions which are situated at these notches having a cross section adapted to be received in the fastener projections.

12 Claims, 8 Drawing Figures

MAT AND UNITS THEREOF

BACKGROUND OF THE INVENTION

The present invention relates to mats, and in particular to bath mats.

The present invention relates in particular to a plurality of identical mat units which can be assembled together so as to form a mat of a desired size and configuration.

Although mats of the above general type are already known, the previously known mats suffer from a number of drawbacks. Thus, the separate units thereof can be joined together only with difficulty and can be separated from each other only with difficulty. Furthermore, where such mat units are made of plastic, they are difficult to cast inasmuch as the known mat units have complex interconnected ribs and hollow as well as undercut portions which are essential in order to provide units which can be connected one to the next. Furthermore, the known units when designed for use as bath mats have between their intersecting ribs relatively small spaces which easily become filled with water so that it is not possible for water to flow effectively downwardly through the spaces between the interconnected ribs. As a result the previously known mats retain liquid in the spaces between the interconnected ribs and become relatively slippery so that they are not as safe as desired.

In addition, the previously known mats do not have relatively smooth upper surfaces so that when an individual with bare feet stands on the previously known mats a considerable discomfort is experienced.

In addition, because the units of previously known mats can be connected to each other and disconnected from each other only with considerable difficulty, if the units which go to make up a mat are first put together in a certain way and it is desired to change the manner in which the units are interconnected, such a change can only be brought about with considerable inconvenience and difficulty.

SUMMARY OF THE INVENTION

It is accordingly a primary object of the present invention to provide a mat, and units therefor, which will avoid the above drawbacks.

Thus, it is an object of the present invention to provide a mat, and units thereof, which are relatively inexpensive to manufacture and which in particular do not require any hollow feet or the like which weaken the mat undesirably while increasing the cost thereof.

Furthermore it is an object of the present invention to provide a mat construction having units which can be readily assembled together and disassembled from each other so that the several units can be put together in a manner which will provide a mat of a desired size and configuration.

Furthermore it is an object of the present invention to provide a mat construction according to which spaces between interconnected ribs will not be so small that by capillary action or surface tension water in the spaces defined by the network of ribs cannot flow downwardly therethrough.

In addition it is an object of the present invention to provide a construction according to which the mat has feet which cooperate with the network of ribs in such a way as to contribute toward the draining of liquid out of the spaces defined between the network of ribs.

Furthermore, it is an object of the present invention to provide a mat construction which is comfortable to the lower surfaces of bare feet.

Also it is an object of the present invention to provide a mat construction which will reliably remain on the surface of a tub or the like in which the mat is placed, so as to provide complete safety in the use of the mat of the invention.

According to the invention the mat includes a plurality of identical one-piece units which are adapted to be situated next to each other and interconnected for forming a continuous mat structure. Each of these units has a continuous peripheral flange having upper and lower edges and an open network of intersecting ribs are surrounded by and integral with this peripheral flange while being situated at least in part between the upper and lower edges thereof, the network of ribs in particular being spaced upwardly from the lower edge of the peripheral flange of each unit. Each unit has a plurality of short feet which are integral with and distributed along while extending downwardly from the lower edge of the peripheral flange, and in addition each unit has a plurality of long feet, which are longer than the short feet, and which are integral with and extend downwardly from the open network of intersecting ribs. All of the above feet terminate in lower ends which are situated in a common plane which is parallel to and lower than a plane which includes the lower edge of the peripheral flange. This peripheral flange has at least one pair of elongated opposed connecting regions one of which carries a plurality of integral fastener projections extending outwardly from this one flange region and each formed with a recess which is directed downwardly and formed with a lower open end. The other of this pair of flange regions is formed with notches for respectively receiving the fastener projections of an adjoining unit, with this other flange region having at its notches flange portions the size and configuration of which enables them to be situated in the recesses of the fastener projections of an adjoining unit.

BRIEF DESCRIPTION OF DRAWINGS

The invention is illustrated by way of example in the accompany drawings which form part of this application and in which.

DESCRIPTION OF A PREFERRED EMBODIMENT

Figure 1:
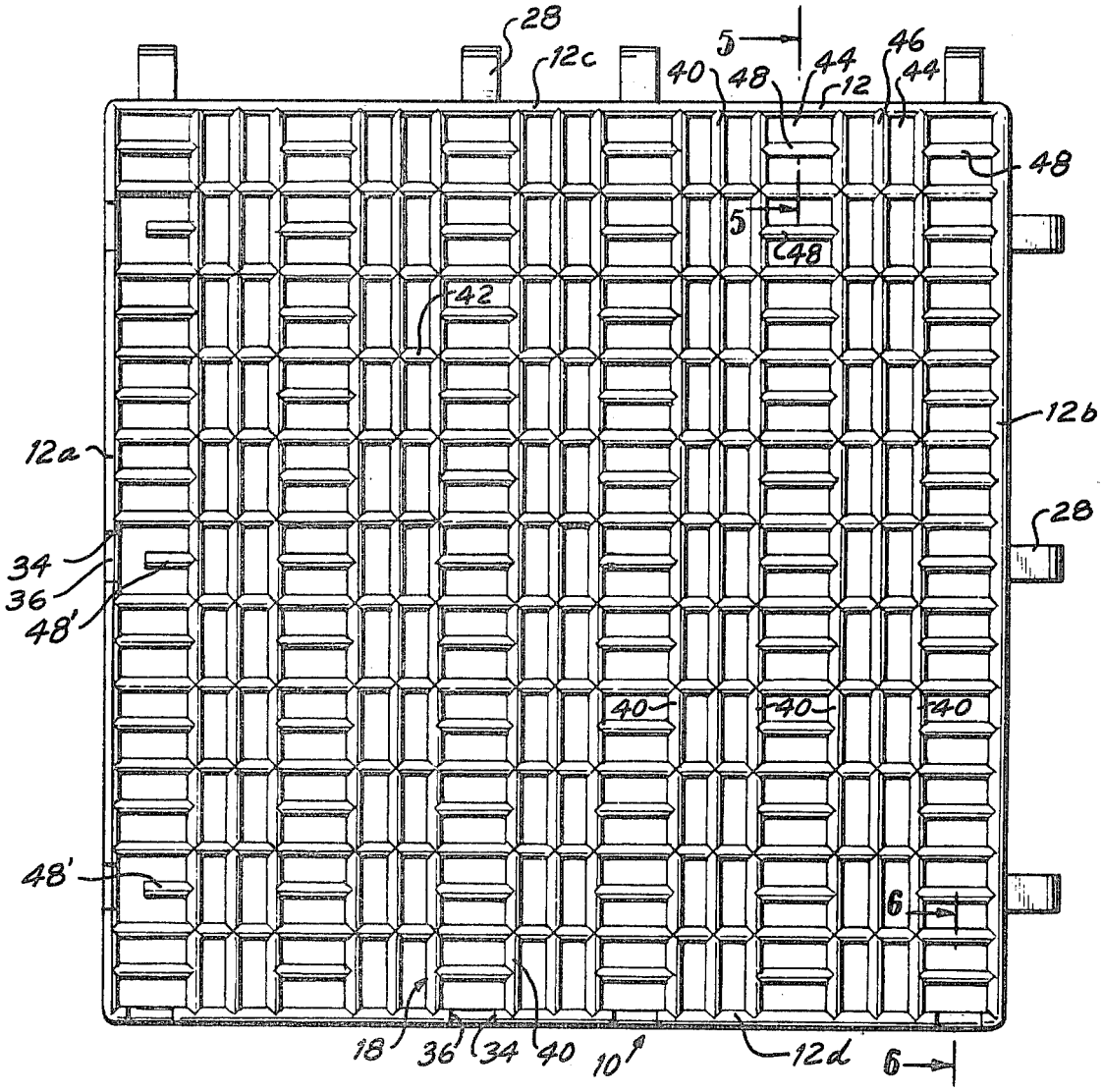
FIG. 1 is a top plan view of a mat unit according to the present invention.
Figure 2:
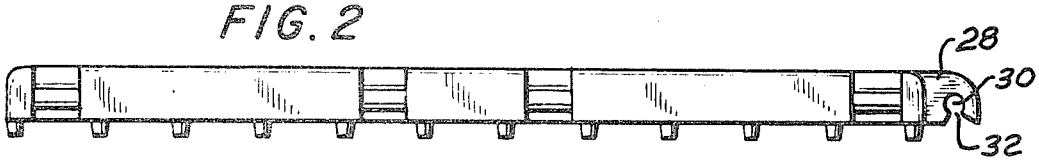
FIG. 2 shows in a side elevation the unit of FIG. 1 as it appears when looking toward the lower edge of the unit of FIG. 1.

Referring now to the drawings, the mat of the invention is adapted to be made up of a plurality of identical units, the details of one of which are illustrated in FIGS. 1–6. Thus, the illustrated mat unit 10 includes a continuous peripheral flange 12 which is of a rectangular or square configuration in the illustrated example. As is apparent particularly from FIG. 5, the flange 12 is of a substantially rectangular cross section, having a lower edge 14 which is flat and an upper edge 16 which is convexly curved. An intersecting network of ribs 18 is situated within and surrounded by the peripheral flange 12 while being integral therewith.

Figure 5:
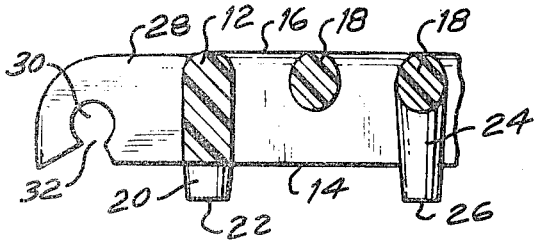
FIG. 5 is a fragmentary sectional illustration of the unit of FIG. 1 taken along line 5—5 of FIG. 1 in the direction of the arrows.
Figure 6:
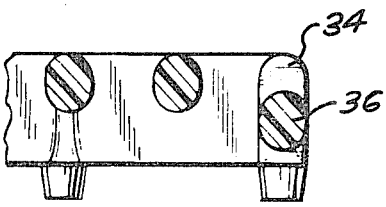
FIG. 6 is a fragmentary sectional illustration of the unit of FIG. 1 taken along line 6—6 of FIG. 1 in the direction of the arrows.

As is apparent particularly from FIGS. 5 and 6, the ribs 18 are situated in part between the upper and lower edges of the flange 12, with the ribs 18 all being situated at an elevation higher than the lower edge 14 of the flange 12. The upper edges of the ribs 18 are convex and in the illustrated example situated in the same plane as the upper edge 16 of the flange 12. Thus, by reason of this feature the upper surface of the unit 10 is comfortable to the soles of bare feet of an individual standing on the units 10.

The above network of ribs 18 and the peripheral flange 12 are all integral with each other and are formed as a single unit by die casting, for example. In addition, the flange 12 is integral with a plurality of short feet 20 which are distributed along the lower edge 14 of the flange 12 in the manner shown most clearly in FIG. 3 and which terminate in lower ends 22 which are flat, these short feet 20 tapering in the manner most clearly apparent from FIGS. 5 and 6.

Figure 3:
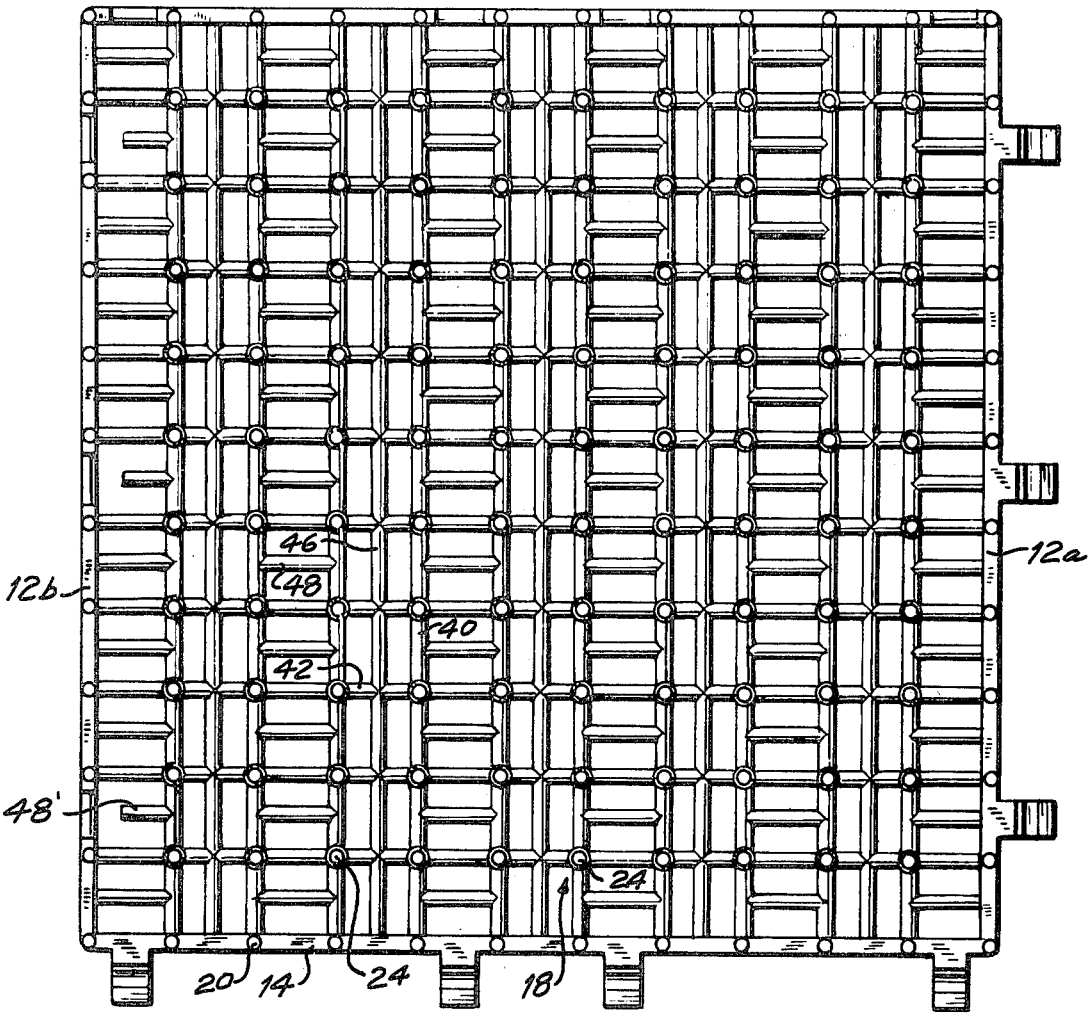
FIG. 3 is a bottom plan view of the unit of FIG. 1.
Figure 4:
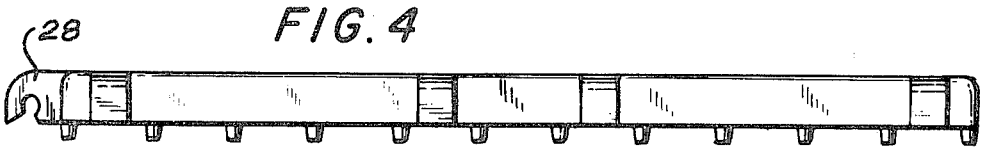
FIG. 4 is a side elevation of the unit of FIG. 1 as seen when looking toward the upper edge of the unit of FIG. 1.

In addition, the network of ribs 18 is integrally formed with a plurality of long feet 24 which are distributed across the network of intersecting ribs 18 in the manner most clearly apparent from FIG. 3, these long feet 24 of course being longer than the feet 20 and also tapering downwardly, as is most clearly apparent from FIG. 5. The several long feet 24 also terminate in lower ends 26 which are flat, and these lower ends 26 are situated in the same plane as the lower ends 22 of the short feet 20, this plane being parallel to the plane which contains the lower edge 14 of the peripheral flange 12.

The peripheral flange 12 has a pair of opposed elongated straight parallel connecting regions **12*a* and 12*b* which are shown in FIGS. 1 and 3. The elongated flange region 12*b* has a plurality of fastening projections 28 integral with and projecting therefrom. It will be noted that in the illustrated example there are three such fastening projections 28 integral with and projecting from the connecting region 12*b* of the peripheral flange 12. As is apparent from FIGS. 2 and 4, these fastening projections 28 are formed with downwardly directed openings 30 which are open at their lower ends and which have a throat region 32**.

The opposite elongated connecting region **12*a* of the flange 12 is formed with a series of notches 34 which are respectively aligned with the projections 28, and at these notches the flange region 12*a* has flange portions 36 which are adapted to be received in the openings 30** in a manner described in greater detail below.

The flange 12 also has a pair of opposed parallel elongated connecting regions **12*c* and 12*d* which are respectively provided with fastener projections 28 and notches 34 where the connecting region 12*d* has the portions 36. One of the fastener projections 28 which projects from the connecting region 12*c* is shown most clearly in FIG. 5, while a portion 36 situated at a notch 34 is shown most clearly in FIG. 6. The width of the notches 34 is sufficient to receive a fastener projection 28 therein, while the cross section of the portion 36 in each notch 34 is such that it is capable of snapping into the opening 30 when passing beyond the throat 32** thereof.

The entire unit 10 is made from any suitable plastic such as polyvinyl chloride, polyvinyl acetate, polystyrene, polybutadiene, polypropylene, or even nylon, and the plastic material is of a somewhat flexible and springy nature so that the portions 36 can readily snap into the openings 30 when passing beyond the throat 32 thereof.

As is apparent from FIGS. 1 and 3, at each connecting region which has the fastening projections 28 there are at least three of these fastening projections, with three such fastening projections being located along the connecting region **12*b* while four fastening projections 28 are situated along the connecting region 12*c*. Of course there are four notches 34 along the connecting region 12*d* respectively in line with the opposed fastening projections 28**.

Figure 7:
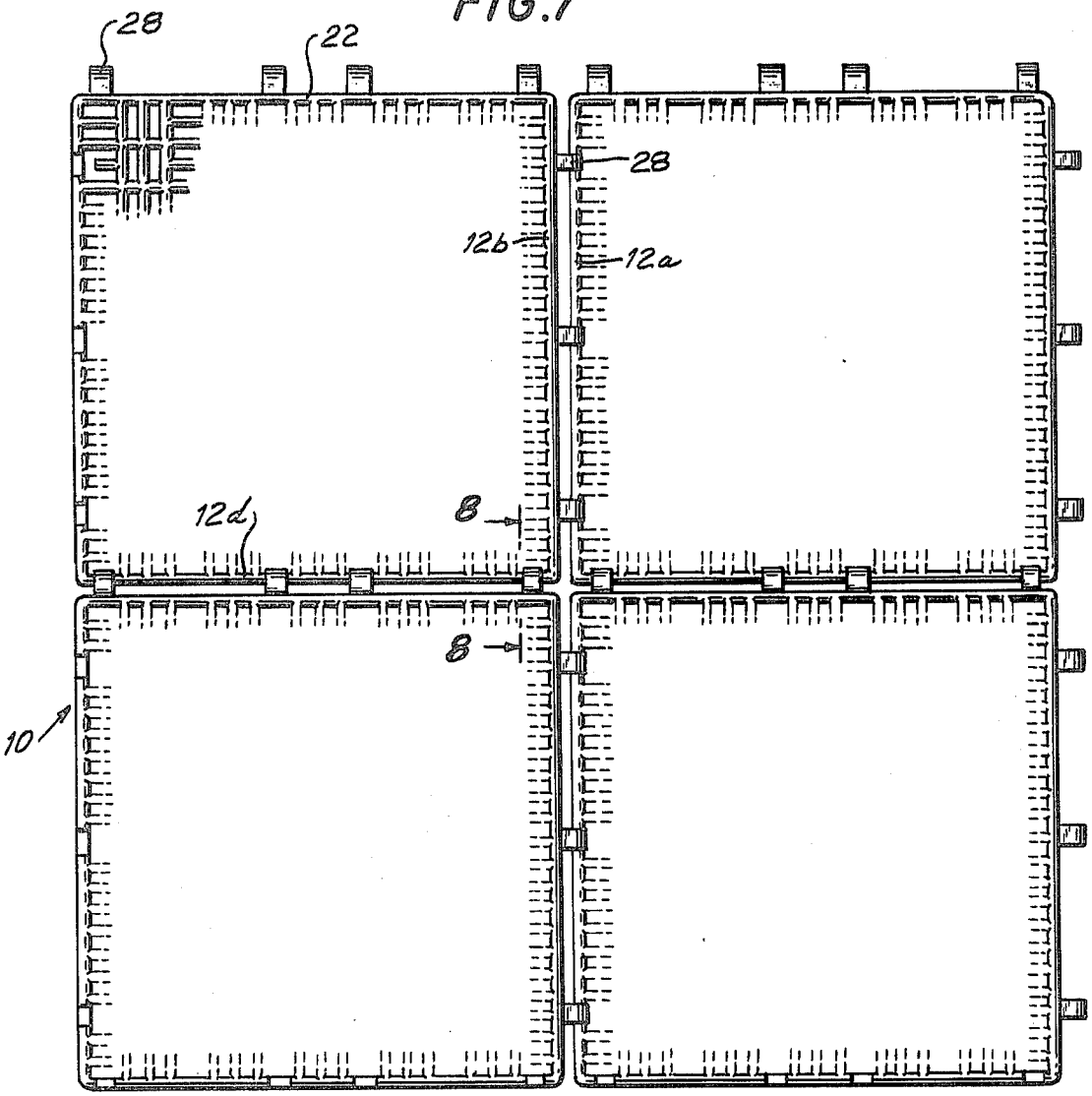
FIG. 7 is a fragmentary top plan view of part of a mat which can be formed by an assembly of the units of FIGS. 1-6.
Figure 8:
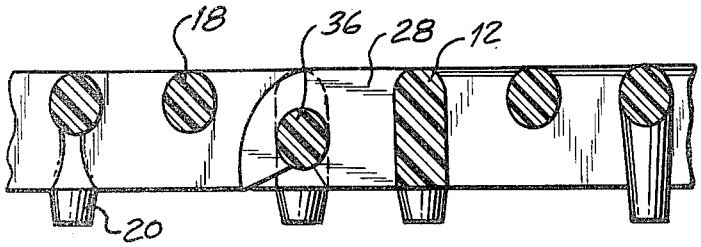
FIG. 8 is a fragmentary sectional view taken along line 8—8 of FIG. 7 in the direction of the arrows and showing in particular how the units are connected to each other.

Referring to FIGS. 7 and 8, the above-described unit 10 can be assembled in the manner shown in FIGS. 7 and 8. Thus, the three projections 28 extending from each connecting region **12*b* will receive the portions 36 situated at a connecting region 12*a* of an adjoining unit. On the other hand, the four projections 28 at a connecting region 12*c* will receive the portions 36 at an adjoining connecting region 12*d* of an adjoining unit. Thus it is possible in this way to assemble the units 10 together in the manner indicated in FIG. 7 where only four such units are illustrated. FIG. 8 shows how the portion 36 at each notch is received in the opening 30 of a fastening projection 28**.

The network of intersecting ribs includes one set of parallel ribs 40 which are parallel to and uniformly distributed between the opposed connecting regions **12*a* and 12*b* of the peripheral flange 12 as most clearly shown in FIG. 1. An additional set of parallel ribs 42 are uniformly spaced from each other and extend parallel to the opposed flange regions 12*c* and 12*d*, and the spaces between the two sets of ribs 40 and 42 are equal so that the intersecting ribs 40 and 42 form square spaces therebetween. Thus, between each pair of adjoining ribs 40 there is a row of square spaces 44. Alternating rows of square spaces 44 are bisected by additional ribs 46 which extend parallel to the ribs 40. The remaining rows of spaces 44 are provided with transverse ribs 48 which bisect the square spaces 44 in which they are situated, so that these ribs 48 are the only relatively short ribs of the entire construction. It will be noted that those ribs 48' which are in line with the notches 34 of the connecting region 12*a* of the flange 12 terminate short of these notches 34 so as to provide spaces to receive parts of the fastening projections 28** of an adjoining unit.

Moreover, as is apparent from FIG. 3, the long feet 24 extend downwardly from the intersections between the sets of ribs 40 and 42.

Thus, by reason of the above arrangement the network of ribs define a series of spaces each of which has a size which is approximately one half the size of the square space 44 defined between the intersecting perpendicular ribs 40 and 42. These relatively small spaces nevertheless are in general large enough to prevent water from filling these spaces by capillary action. However it will be noted that because the long feet 24 are situated at the intersections between the intersecting ribs 40 and 42, every single space defined between the intersecting ribs communicates with at least a pair of the long feet 24, so that by surface tension the liquid will flow along the surfaces of the feet 24 to contribute in this way also to prevention of filling of the spaces between the network of ribs with the liquid which will be retained in these spaces.

Moreover, all of the ribs, the peripheral flange, the fastening projections 28 and the feet are solid so that it unnecessary to mold any hollow component with the structure of the invention. In addition, the structure of the invention is somewhat flexible so that not only can it conform to the curvature at the bottom of a tub, for example, but in addition this flexibility contributes also to the comfort and safety of a bath mat made up of the units of the invention. These units can be rapidly and inexpensively cast as by die casting, so that the structure of the invention is exceedingly inexpensive.

At the same time, it is easy and convenient very rapidly to put together a number of the units 10 so as to provide a bath mat of any desired size and configuration, and whenever desired it is a simple matter to separate the fastening projections 28 from the portions 36 so as to change the configuration of the mat or take it apart for any reason.

What is claimed is:

1. A mat comprising a plurality of identical one-piece units adapted to be situated next to each other and interconnected for forming a continuous mat structure, each of said units being formed of plastic material having a continuous peripheral flange defined by a first pair of straight, parallel, opposed flange sides and a second pair of straight, opposed parallel flange sides extending transversely between said first pair of flange sides, said flange having upper and lower edges and an open network of intersecting ribs surrounded by and integral with said flange and situated at least in part between the upper and lower edges of said flange while being spaced upwardly from said lower edge of said flange, said open network of intersecting ribs including a first set of substantially equally spaced ribs extending between said second pair of flange sides parallel to said first pair of flange sides and a second set of substantially equally spaced ribs extending between said first pair of flange sides parallel to said second pair of flange sides, said first and second sets of ribs being integrally formed with and intersecting each other defining a plurality of adjacent rows of square spaces, a first set of alternate rows of spaces including elongate additional ribs extending parallel to said first pair of flange sides, substantially bisecting each of said square spaces in said first set of alternate rows and a second set of alternate rows of spaces including elongate additional ribs extending parallel to said second pair of flange sides substantially bisecting each of said square spaces in said second set of alternate rows, each unit having a plurality of short feet integral with and distributed along said flange and extending downwardly from said lower edge thereof and a plurality of long feet longer than said short feet and being integral with said open network of intersecting ribs and extending downwardly therefrom, all of said feet terminating in lower ends situated in a common plane parallel to and lower than a plane which includes said lower edge of said flange, at least one pair of flange sides comprising a pair of elongated opposed connecting regions one of which carries a plurality of integral fastener projections extending outwardly from said one flange region and each formed with a recess which is directed downwardly and formed with a lower open end, the other of said pair of flange regions being formed with notches for respectively receiving the fastener projections of an adjoining unit with said other flange region having at said notches flange portions the size and configuration of which enables them to be situated in said recesses of the fastener projections of an adjoining unit and wherein some of said ribs extend perpendicularly with respect to said other flange region respectively in line with but terminating short of said notches thereof to provide spaces for receiving said fastener projections of an adjoining unit.

2. The combination of claim 1, and said flange of each unit having a second pair of flange sides comprising a pair of opposed flange regions which extend transversely with respect to said one pair of opposed flange regions and which respectively have a plurality of fastener projections and notches identical with those of said one pair of opposed flange regions for interconnecting each unit with additional units arranged transversely with respect to additional units which are interconnected with said one pair of flange regions of each unit.

3. The combination of claim 2 and wherein said first and second pairs of flange sides are perpendicular to each other.

4. The combination of claim 3 and wherein said peripheral flange is of a square configuration.

5. The combination of claim 1 and wherein said peripheral flange is of a substantially rectangular cross section.

6. The combination of claim 5 and wherein said peripheral flange is flat at said lower edge thereof and is convexly curved at said upper edge thereof.

7. The combination of claim 6 and wherein said ribs have upper convexly curved edges situated at the same elevation as said upper edge of said flange.

8. The combination of claim 1 and wherein said ribs have upper edges situated in the same plane as said upper edge of said flange.

9. The combination of claim 1 and wherein there are at least three of said fastener projections distributed along said one flange region and three of said notches distributed along the other of said flange regions.

10. The combination of claim 1 and wherein said long feet extend downwardly from the intersections between said sets of ribs.

11. The combination of claim 1 and wherein said peripheral flange is of a substantially rectangular cross section while said ribs are of a substantially circular cross section.

12. The combination of claim 1 and wherein all of said feet taper in a downward direction and have a minimum cross sectional area at their lower ends.

* * * * *